United States Patent [19]

Perez

[11] Patent Number: 4,743,897

[45] Date of Patent: May 10, 1988

[54] LED DRIVER CIRCUIT

[75] Inventor: Ricardo Perez, Gent, Belgium

[73] Assignee: Mitel Corp., Kanata, Canada

[21] Appl. No.: 785,653

[22] Filed: Oct. 9, 1985

[51] Int. Cl.[4] ..... G09G 3/32

[52] U.S. Cl. ..... 340/813; 340/761; 340/762

[58] Field of Search ..... 340/761, 813

[56] References Cited

U.S. PATENT DOCUMENTS 3,548,403 12/1970 Johnson ..... 340/715
4,017,847 4/1977 Burford et al. ..... 340/761
4,112,424 9/1978 Lapeyre ..... 340/761
4,198,629 4/1980 Marion ..... 340/761

*Primary Examiner*—Marshall M. Curtis
*Attorney, Agent, or Firm*—Antonelli, Terry & Wands

[57] ABSTRACT

An LED driver circuit including a current source for generating constant drive current to a plurality of series connected LEDs, circuitry for selectively enabling and disabling predetermined ones of the LEDs and further circuitry for disabling the current source in the event none of the LEDs are enabled. The LED driver circuit is of simple design and low cost, and is characterized by low power consumption due to the current source being disabled in the event none of the LEDs are enabled.

18 Claims, 1 Drawing Sheet

LED DRIVER CIRCUIT

Figure 1:
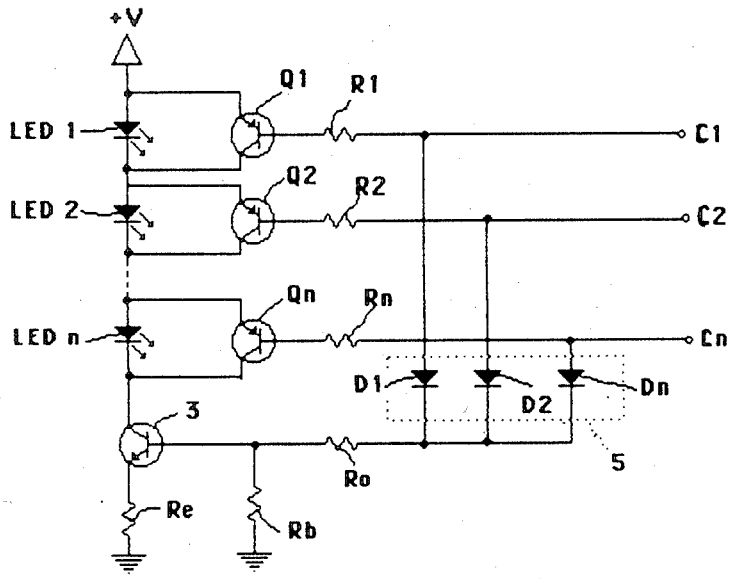

The present invention relates in general to Light Emitting Diode (LED) circuits, and more particularly to a constant current LED driver circuit.

LEDS are well known in various arts for displaying information. For example, modern automatic cameras have been provided with circuitry for determining the shutter speed and aperture in response to the degree of light exposure, and displaying the results on an LED bar graph display. Likewise, speeds of vehicles, levels of fullness in containers, line status of a telephone circuit and volume levels of audio devices have all been displayed using LEDs arranged in luminous strips or as bar graphs.

The arranged LEDs are required to be driven by a current source in the form of a driver circuit. One prior art LED driver circuit utilized a plurality of current limiting resistors connected in series between a variable current supply and individual LEDs, forming a plurality of parallel circuits. In order to illuminate one or more of the LEDs, one or more control signals are applied to respective base inputs of one or more transistors connected with current conduction paths thereof in series with respective ones of the LEDs and ground. The transistors are biased on in response to receiving enable control signals, and a current of typically from 5 to 10 milliamps flows from the current source through each of the current limiting resistors, each of the LEDs and the transistors to ground. Thus, the total current drawn by the circuit increases with the number of LEDs being enabled, resulting in considerable power loss through Joule heating of the resistors.

Another prior art LED driver circuit is described in U.S. Pat. No. 3,796,951 of Joseph, issued Mar. 12, 1974. The Joseph patent teaches a solid-state electronic gauge comprised of a series of LEDs connected to a constant current source. Consecutive ones of the LEDs are illuminated in response to variations in the level of an input analog signal. A plurality of transistors are arranged such that each transistor is connected in parallel across each LED, and the input analog signal is applied to the bases of the transistors in order to enable successive ones of the transistors, thereby short-circuiting the associated LEDs. With the transistors disabled, the LEDs are biased on so as to be illuminated in the form of a luminous strip whereby the magnitude of the input analog signal is inversely proportional to the number of illuminated LEDs. Because the bases of each of the transistors are connected via resistors to the input voltage source, there is no provision for illuminating individual ones of the LEDs. In addition, there is no provision for disabling the constant current source when none of the LEDs are illuminated. Thus, according to Joseph, current is drawn constantly through the circuit regardless of whether or not the LEDs are illuminated, resulting in considerable power dissipation through Joule heating.

U.S. Pat. No. 3,959,791 issued Mar. 25, 1976, of Takahashi et al describes a digital display system comprised of a plurality of series connected LEDs connected to a constant current source. Individual ones of the LEDs are connected in parallel with a parallel connection of two switches. Predetermined ones of the switches are closed in order to short-circuit predetermined ones of the LEDs such that one or more of the LEDs are selectively enabled or disabled in response to predetermined ones of the switches being opened or closed. Thus, while it is possible to selectively illuminate individual ones of the LEDs, there is no provision for disabling the constant current drive in the event none of the LEDs are illuminated.

U.S. Pat. No. 4,183,021 of Gerstner, issued Jan. 8, 1980, describes a circuit arrangement comprised of two current branches each having a plurality of LEDs connected in series and a plurality of control lines each connected to one side of at least one LED. The Gerstner device is not a constant current driver circuit. In order to illuminate two or more LEDs, they are connected in parallel to a current source such that the current drawn is proportional to the number of LEDs illuminated.

According to the present invention, a constant current LED driver circuit is provided for driving a plurality of LEDs with a constant low amperage current. The LEDs are selectively enabled and disabled in response to generation of predetermined control signals, and a further circuit is provided for disabling the constant current source in the event none of the LEDs are conducting, thereby conserving power and overcoming the disadvantages of prior art LED driver circuits.

In general, the invention is an LED driver circuit comprised of a current source for generating and transmitting constant drive current to a plurality of series connected LEDs, a first circuit for selectively enabling and disabling a predetermined one or more of the LEDs and an additional circuit for disabling the current source in the event none of the LEDs are enabled.

More particularly, the invention is an LED driver circuit for controlling selective illumination of a plurality of series connected LEDs, comprising a current source for generating and transmitting drive current to the LEDs, circuitry for generating enable and disable control signals, control circuitry for receiving the control signals and selectively enabling and disabling predetermined ones of the LEDs in response thereto, and disable circuitry for disabling the current source in the event each of the LEDs is disabled, whereby the LEDs draw constant current in the event one or more are enabled and draw no current in the event each of the LEDs is disabled.

A better understanding of the present invention will be obtained with reference to the detailed description below in conjunction with the following drawing, in which:

FIG. 1 is a schematic diagram of a constant current LED driver circuit according to a preferred embodiment of the present invention.

With reference to FIG. 1, a plurality of light emitting diodes LED 1, LED 2, . . . , LED n are connected in series to a source of constant voltage +V, of sufficient voltage to forward bias the light emitting diodes. A plurality of PNP transistors, Q1, Q2, . . . Qn are connected across respective ones of diodes LED 1, LED 2, . . . , LED n with their emitter terminals connected to the anodes of respective ones of the LEDs and their collector terminals connected to the cathodes of the LEDs. Base terminals of transistors Q1, Q2, . . . , Qn are connected via input resistors $R_1$, $R_2$, . . . , $R_n$ to respective control input terminals, C1, C2, . . . , Cn. The control input terminals are connected to a control circuit (not shown) for generating control signals in order to selectively enable respective ones of the LEDs via the transistors. The control circuit can be for instance, a microprocessor.

An NPN transistor 3 is shown having a collector terminal thereof connected to the cathode terminal of LED n and an emitter terminal connected to ground via resistor Re. A base terminal of transistor 3 is connecteed via resistor Rb to ground and via resistor Ro to an output of an OR gate 5, which in the successful prototype was comprised of a plurality of diodes D1, D2, . . . , Dn having their cathodes connected together and their anodes connected to respective ones of the control inputs C1, C2, . . . , Cn.

Transistor 3, in conjunction with the source of voltage +V and resistors Re and Rb, comprises a constant current source which according to the successful prototype conducted a 5 milliamps DC current through the series connected LEDs and the collector-emitter circuit of transistor 3. In operation, a logic high signal from OR gate 5 and applied to the base terminal of transistor 3 via resistor Ro results in a constant base voltage across resistor Rb, which in turn biases on the base emitter junction of transistor 3, thereby establishing a constant emitter voltage across resistor Re and consequently a constant DC current flowing therethrough.

In operation, individual ones of the LEDs are selectively enabled in response to control signals being applied to the control terminals, C1, C2, . . . , Cn. For example, in the event a logic high signal is applied to the C2 terminal and logic low signals are applied to the remainder of the control terminals, each of the transistors Q1–Qn are enabled except for transistor Q2 which is biased off. Thus, current flows from the voltage source +V through the collector-emitter circuits of each of the transistors Q1–Qn except transistor Q2 which is biased off, and current flowing through LED 2 causes the LED to illuminate. The logic high signal applied to control terminal C2 is also applied via diode D2 to the base terminal of transistor 3 via resistor Ro, for biasing the transistor on. Thus, in this manner, constant current flows through the series connection of enabled ones of the transistors Q1–Qn and LED 1–LED n in the event at least one of the control terminals C1–Cn has a logic high signal applied thereto and the corresponding LED is conducting.

However, in the event each of the LEDs, LED 1–LED n is disabled, (i.e. logic low signals are applied to each of the control terminals C1–Cn), the output of OR gate 5 goes to a logic low level, thereby biasing off transistor 3 such that no current flows.

In this way, considerable power is saved when the circuit is in an idle state (i.e. no LEDs are illuminated).

A person understanding the present invention may conceive of other embodiments or modifications thereof. For example, transistors Q1–Qn can be NPN transistors provided a NAND gate is substituted for OR gate 5. Likewise, transistor 3 can be a PNP transistor provided a NOR gate is substituted for OR gate 5. Similarly, the transistors Q1–Qn and transistor 3 may be metal oxide semiconductor (MOS) transistors instead of the illustrated binary junction (BJT) transistors.

All these and other variations or modification are considered to be within the sphere and scope of the present invention as defined by the claims appended hereto.

I claim:

1. An LED driver circuit, powered by a supply voltage, for controlling selective illumination of a plurality of series connected LEDs, comprising:

(a) a current source for regulating and transmitting drive current to said LEDs, (b) external means for generating logic level enable and disable control signals, (c) control means for receiving said control signals and selectively enabling and disabling predetermined ones of the LEDs in response thereto, and (d) disable means, responsive to the logic levels of the control signals, for disabling said current source in the event all of said series connected LEDs are disabled, whereby, in response to the logic levels of the control signals, said LEDs conduct constant current therethrough when one or more of said series connected LEDs is enabled and said LEDs draw no current when all of said series connected LEDs are disabled.

2. An LED driver circuit as defined in claim 1, wherein said control means is comprised of means for short circuiting anode and cathode portions of respective ones of said predetermined LEDs via respective short circuit paths in response to receiving respective disable logic level control signals, and open circuiting said short circuit paths in response to receiving respective enable logic level control signals.

3. An LED driver circuit as defined in claim 2, wherein said means for short circuiting said anode and cathode portions is comprised of a plurality of transistors, each having current conduction paths connected in parallel with respective ones of said predetermined LEDs and control inputs for receiving said control signals from said means for generating said control signals.

4. An LED driver circuit as defined in claim 1, wherein said current source forms a series connection with said LEDs and wherein said disable means is comprised of circuit means, coupled to said current source, for monitoring the logic levels of said control signals and open circuiting said series connection when all of said control signals correspond to a disable logic level.

5. An LED driver circuit as defined in claim 3 wherein said transistors are PNP transistors having emitter terminals connected to said anode portions, collector terminals connected to said cathode portions and base terminals connected to said means for generating said control signals.

6. An LED driver circuit as defined in claim 1, wherein said current source comprises a transistor and said disable means is comprised of an OR gate having a plurality of inputs and an output, said transistor having a current conduction path in series connection with said series connected LEDs and a control input connected to the output of said OR gate, and each respective input of said OR gate being connected to said means for generating said control signals, for detecting enable logic level control signals and, in response thereto, enabling said transistor via said output, whereby said transistor is enabled in response to said OR gate detecting at least one enable logic level control signal and said transistor is disabled in response to said OR gate detecting no enable logic level control signals.

7. An LED driver circuit as defined in claim 2, wherein said current source forms a series connection with said LEDs and wherein said disable means is comprised of circuit means, coupled to said current source, for monitoring the logic levels of said control signals and open circuiting said series connection when all of said control signals correspond to a disable logic level.

8. An LED driver circuit as defined in claim 3, wherein said current source forms a series connection with said LEDs and wherein said disable means is comprised of circuit means, coupled to said current source, for monitoring the logic levels of said control signals and open circuiting said series connection when all of said control signals correspond to a disable logic level.

9. An LED driver circuit, powered by a supply voltage, for controlling selective illumination of a plurality of series connected LEDs, comprising:

(a) a current source, including a transistor having a control input and a current conduction path for providing regulated drive current to said LEDs, (b) external means for generating logic level enable and disable control signals, (c) control means for receiving said control signals and selectively enabling and disabling predetermined ones of the LEDs in response thereto, and (d) disable means for disabling said current source in the event each of said LEDs is disabled, wherein said disable means is comprised of an OR gate having a plurality of inputs and an output, said transistor having its current conduction path in series connection with said series connected LEDs and its control input connected to an output of said OR gate, respective inputs of said OR gate being connected to said external means for detecting said enable and disable logic level control signals and in the event no enable control signals are detected disabling said transistor via said output, and in the event at least one enable logic level control signal is detected enabling said transistor, whereby said LEDs conduct constant current therethrough in the event one or more of said series connected LEDs is enabled and said LEDs conduct no current in the event all of said series connected LEDs are disabled.

10. An LED driver circuit, powered by a supply voltage, for controlling selective illumination of a plurality of series connected LEDs, comprising:

(a) a currrent source for regulating and transmitting drive current to said LEDs, (b) means for receiving externally produced logic level enable and disable control signals, (c) control means responsive to said control signals for selectively enabling and disabling predetermined ones of the LEDs, and (d) disable means, responsive to the logic levels of the control signals, for disabling said current source in the event disable logic levels corresponding to all said LEDs are received by said receiving means, whereby, in response to the logic levels of the control signals, said LEDs conduct constant current therethrough when one or more of said series connected LEDs is enabled and said LEDs conduct no current when all of said series connected LEDs are disabled.

11. An LED driver circuit as defined in claim 10, wherein said control means is comprised of means for short circuiting anode and cathode portions of respective ones of said predetermined LEDs via respective short circuit paths in response to receiving respective disable logic level control signals, and open circuiting said short circuit paths in response to receiving respective enable logic level control signals.

12. An LED driver circuit as defined in claim 11, wherein said means for short circuiting anode and cathode portions is comprised of a plurality of transistors, each having current conduction paths connected in parallel with respective ones of said predetermined LEDs and control inputs for receiving said control signals from said means for receiving said externally produced control signals.

13. An LED driver circuit as defined in claim 10, wherein said current source forms a series connection with said LEDs and wherein said disable means is comprised of circuit means, coupled to said current source, for monitoring the logic levels of said control signals and open circuiting said series connection when all of said control signals correspond to a disable logic level.

14. An LED driver circuit as defined in claim 12, wherein said transistors are PNP transistors having emitter terminals connected to said anode portions, collector terminals connected to said cathode portions and base terminals connected to said means for receiving said externally produced control signals.

15. An LED driver circuit as defined in claim 10, wherein said current source comprises a transistor and said disable means is comprised of an OR gate having a plurality of inputs and an output, said transistor having a current conduction path in series connection with said series connected LEDs and a control input connected to the output of said OR gate, and each respective input of said OR gate being connected to said means for generating said control signals, for detecting enable logic level control signals and, in response thereto, enabling said transistor via said output, whereby said transistor is enabled in responses to said OR gate detecting at least one enable logic level control signal and said transistor is disabled in response to said OR gate detecting no enable logic level control signals.

16. An LED driver circuit as defined in claim 11, wherein said current source forms a series connection with said LEDs and wherein said disable means is comprised of circuit means, coupled to said current source, for monitoring the logic levels of said control signals and open circuiting said series connection when all of said control signals correspond to a disable logic level.

17. An LED driver circuit as defined in claim 12, wherein said current source forms a series connection with said LEDs and wherein said disable means is comprised of circuit means, coupled to said current source, for monitoring the logic levels of said control signals and open circuiting said series connection when all of said control signals correspond to a disable logic level.

18. An LED driver circuit, powered by a supply voltage, for controlling selective illumination of a plurality of series connected LEDs, comprising:

(a) a current source, including a transistor having a control input and a current conduction path for providing regulated drive current to said LEDs, (b) means for receiving externally produced logic level enable and disable control signals, (c) control means responsive to said control signals for selectively enabling and disabling predetermined ones of the LEDs, and (d) disable means for disabling said current source in the event all of said LEDs are disabled, wherein said disable means is comprised of an OR gate having a plurality of inputs and an output, said transistor having its current conduction path in series connection with said series connected LEDs and its control input connected to an output of said OR gate, respective inputs of said OR gate being connected to said means for receiving said externally produced enable and disable logic level control signals and in the event no enable control signals are received disabling said transistor via said output, and in the event at least one enable logic level control signal is received enabling said transistor, whereby said LEDs conduct constant current therethrough in the event one or more of said series connected LEDs is enabled and said LEDs conduct no current in the event all of said series connected LEDs are disabled.

* * * * *